US006644881B1

(12) United States Patent
Dawan

(10) Patent No.: US 6,644,881 B1
(45) Date of Patent: Nov. 11, 2003

(54) SOAP DISPENSING WASHCLOTH SYSTEM AND METHOD

(76) Inventor: Ouadir N. Dawan, 4354 S. Berkeley St. #2N, Chicago, IL (US) 60653

( * ) Notice: Subject to any disclaimer, the term of this patent is extended or adjusted under 35 U.S.C. 154(b) by 0 days.

(21) Appl. No.: 10/125,175

(22) Filed: Apr. 17, 2002

(51) Int. Cl.[7] ..... A47K 7/02; B43K 8/10

(52) U.S. Cl. ..... 401/201; 15/208; 428/78; D6/608

(58) Field of Search ..... 401/201, 196; D6/608; 15/208; 428/102, 78

(56) References Cited

U.S. PATENT DOCUMENTS 1,404,401 A * 1/1922 Novick ..... 401/201
2,669,737 A * 2/1954 Evans ..... 401/201
5,326,610 A 7/1994 Moss ..... 428/78
5,545,456 A * 8/1996 Suida ..... 15/208
D433,590 S 11/2000 Johnson ..... D6/608
6,206,596 B1 3/2001 Johnson ..... 401/6

* cited by examiner

*Primary Examiner*—Tuan N. Nguyen
(74) *Attorney, Agent, or Firm*—Clifford Kraft

(57) ABSTRACT

A soap dispensing washcloth system and method where an elastic tulle pocket is attached to a washcloth to dispense soap through cellular holes. The pocket is made by folding a flat piece of tulle into two overlapping flaps which are then stitched perpendicularly to the folds forming a pocket that supports soap in four directions. This pocket is then attached to any washcloth to form a soap dispensing system from which the soap cannot become dislodged accidentally, but can be easily removed. Because elastic tulle material is water permeable, water flows freely in and out of the pocket to dispense soap. The soap can be removed for a soap-free rinse.

18 Claims, 4 Drawing Sheets

SOAP DISPENSING WASHCLOTH SYSTEM AND METHOD

BACKGROUND

1. Field of the Invention

The present invention relates generally to the field of personal hygiene and more particularly to a soap dispensing washcloth system and method.

2. Description of Related Art

When taking a shower or bath, it is usually necessary to hold a slippery bar of soap using one hand and a washcloth using a second hand. It is very desirable to combine the functions of soap dispensing and those of a washcloth into a single system Washcloths containing pockets or pouches for inserting soap are known in the art. For example U.S. Des. Pat. No. D413,477 shows a flat design with an internal pocket. Other prior art washcloths have been shaped like gloves, etc. All of these prior art systems have soap compartments made in the form of simple pockets and sewed from the same material as the washcloth. These prior art methods suffer from several severe disadvantages. First, since they are made from the same material as the washcloth, they are partially impermeable—that is, soap does not readily travel from the soap compartment to the outer surface, and hence onto the skin. Second, because of the nature of the simple pockets in prior art devices, the soap has a tendency to work its way out. This can cause the soap to fall to the shower floor either hitting the person's foot or at least causing the person to stoop over in the shower spray to retrieve the bar of soap. This can be a nuisance and even dangerous.

What is badly needed is a system and method for dispensing soap from a washcloth without the danger of the soap becoming free, and for dispensing the soap in such a way that the soap transfers readily from the bar to the skin without having to pass through washcloth material.

SUMMARY OF THE INVENTION

The present invention solves the above mentioned problems of dispensing soap from a washcloth by providing a washcloth with a specially positioned and specially constructed soap-containing pocket made of a stretch tulle material.

Stretch tulle is a net-like material that is used as inner liners in bathing suits and other garments. It is made by sewing stretch threads in a tight cell pattern. The actual threads are elastic and can be stretched to about 50–75% of their length. The preferred material used for the present invention has cell sizes around 1 mm. It should be understood that many different types of tulle material, with different cell sizes, can be used and will function in a similar manner. Stretch tulle stretches to accommodate different size soap bars, and it is totally permeable to water. In other words, fresh water flows into the pocket and contacts the soap exactly as it would if the soap were held in the hand. Soap leaves the bar or reservoir and flows out to the skin again exactly as it does when the soap is hand held. The preferred size of the mesh actually allows considerable areas of direct soap contact with wet skin. Stretch tulle is generally around 93–95% polyester and 5–7% lycra for elasticity. Stretch tulle is well known and can be purchased anywhere textile materials are sold. However any cell containing, water permeable fabric made from partially elastic thread is within the scope of the present invention. For purposes of this application, elastic tulle shall be defined as any water permeable fabric woven in cells from partially elastic thread.

The present invention also can include a specialized folded pocket construction that facilitates holding different size soap bars with no danger of losing the soap once inserted. The unique pocket construction nevertheless allows any soap bar to be easily removed at any time. In addition, the present invention places the tulle pocket in a unique position on the washcloth to maximize convenience and functionality.

DESCRIPTION OF THE DRAWINGS

The present invention is illustrated and explained by various drawings as follows.

It should be noted that the figures described are for the purpose of illustrating a possible embodiment and method of making the present invention. It will be recognized by one skilled in the art that many other configurations are within the scope of the present invention.

DETAILED DESCRIPTION

Figure 1:
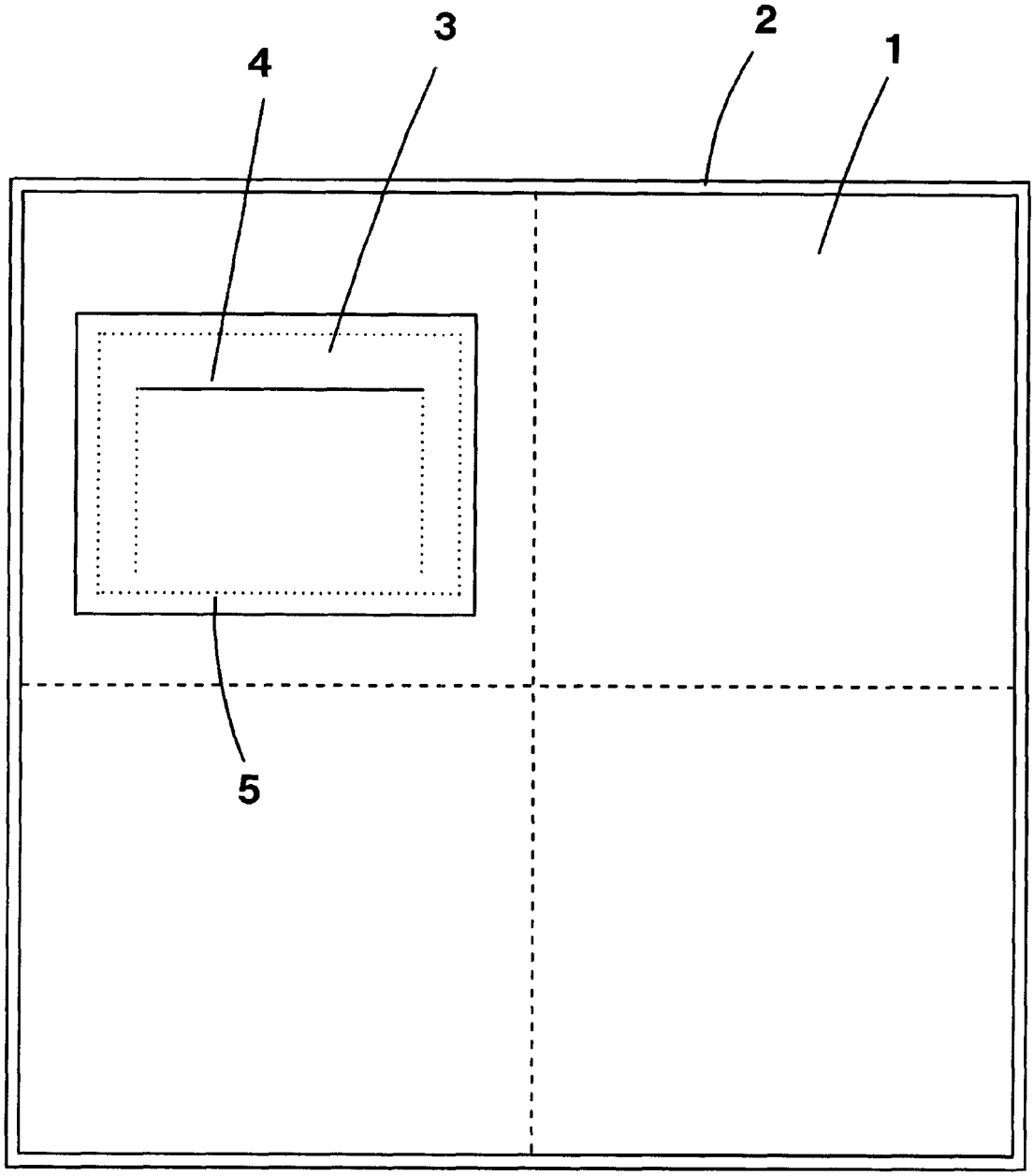
FIG. 1 is a face view of an embodiment of the present invention showing a washcloth with a specially constructed tulle pocket.

Turning to FIG. 1, a face view of a washcloth 1 can be seen. This washcloth 1 can be made of any standard towel type material normally used to make washcloths. An optional border or margin 2 can be sewed around the outside perimeter of the washcloth. A pocket 3 made of elastic tulle material can be sewed onto one quadrant of the washcloth 1. The advantage of this particular location is that it leaves ¾ of the cloth free for normal scrubbing, and dedicates ¼ to soap dispensing. It should be understood that this particular location and arrangement of the tulle pocket is optional. It is within the scope of the present invention to locate the pocket anywhere on the washcloth.

A slit 4 is visible to the user on the upper face of the pocket 3. This slit 4 is where soap is inserted into the specially constructed pocket. The entire pocket is stitched 5 all around to secure it to the washcloth. The preferred thread is a blend of around 37% mercerized cotton and 63% polyester. While any strong thread can be used, the preferred blend yields high strength so the pocket 3 will not become detached from the washcloth 1. The thread color should match the color of the washcloth for maximum appeal; however, the color is not important to the functioning of the invention and can be chosen for any effect desired.

Figure 2:
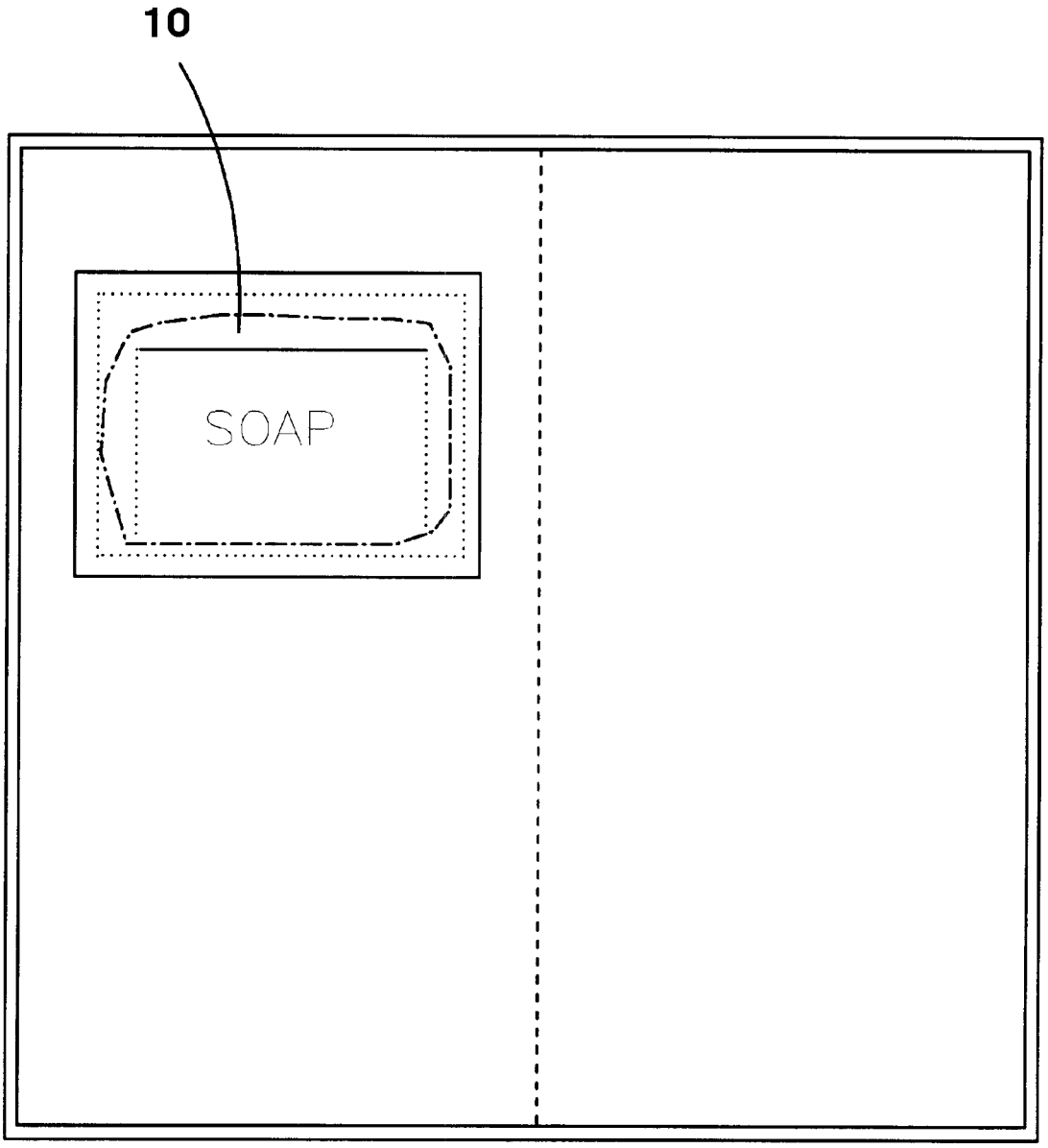
FIG. 2 is the same view as FIG. 1 except that the position of an inserted soap bar is shown.

FIG. 2 is similar to FIG. 1, except that a bar of soap 10 is shown inserted into the specially constructed pocket. It should be remembered that soap in forms other than bars can be used. In particular, small pieces of soap bars that might normally be discarded can be effectively placed in the stretch pocket. Also soap flakes can be used effectively. Soap bars can be used in various sizes including 4–6 oz. bars (or any other bar size), and can be any shape including, but not limited to, rectangular, circular and oval.

Figure 3:
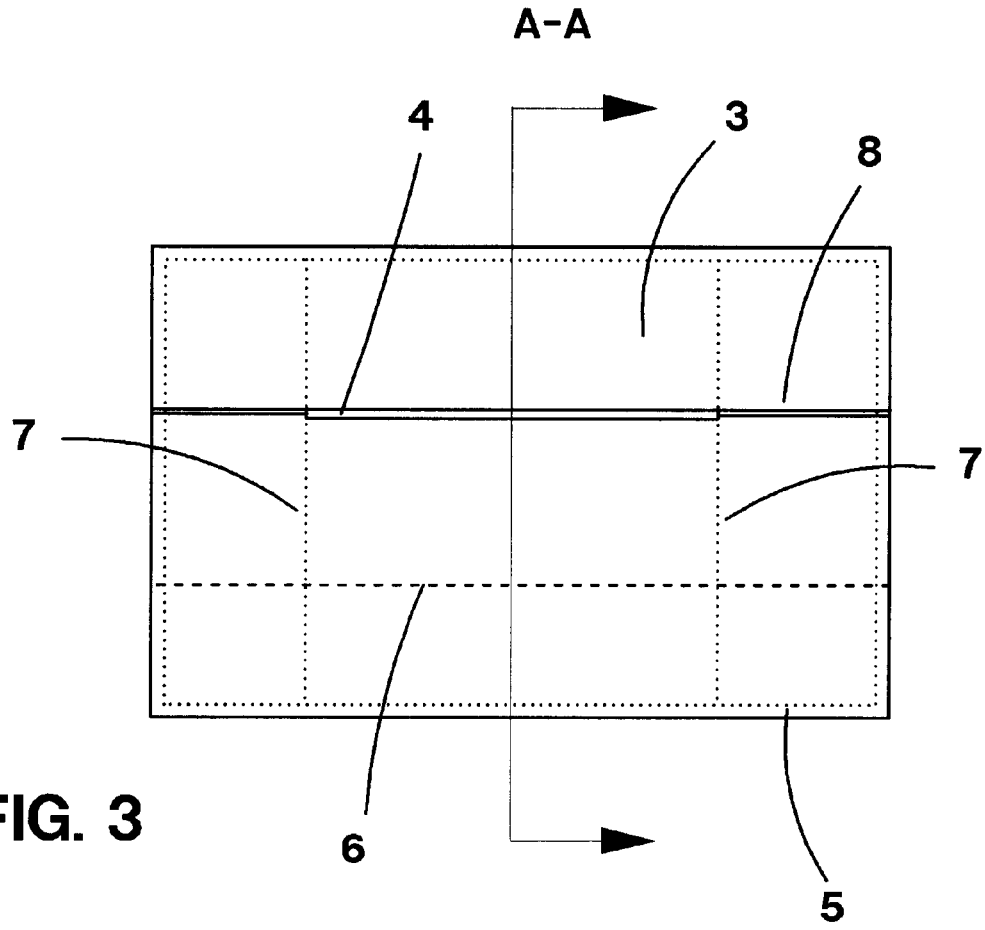
FIG. 3 shows details of a specially constructed tulle pocket.
Figure 4:
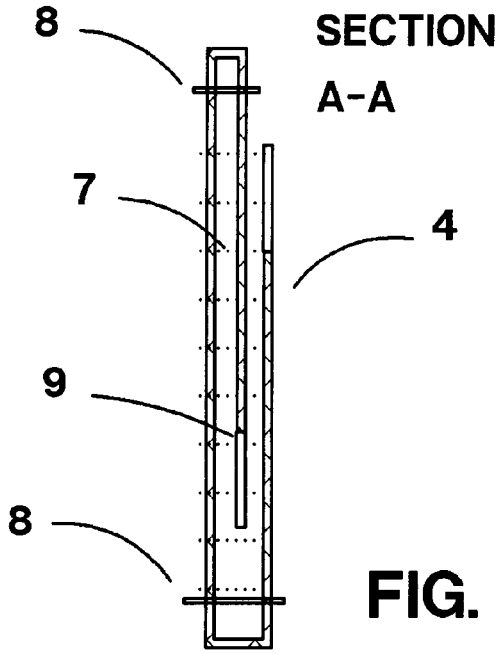
FIG. 4 shows section A—A from FIG. 3.

FIG. 3 shows details of construction of a tulle pocket that is particularly effective with the present invention. FIG. 4 shows an illustrative section A—A of FIG. 3. It can be seen from these figures that the tulle pocket 3 can be made with an inner flap 9 and an outer flap 4. These two flaps are first made by simply folding the tulle. Stitches 7 sewed vertically across the folds 6, 8 hold the pocket together. It is important to note that the vertical stitches 7 do not penetrate into the washcloth material as do the retaining stitches 5. This causes an internal pocket to form that has effective covers extending over the soap in all four directions. The resulting slit 4 is left open for ultimate insertion and removal of the bar. The soap is first inserted downward into slit 4 and tucked up under fold 6. This places the soap squarely into the pocket with support in all four directions.

Figure 5:
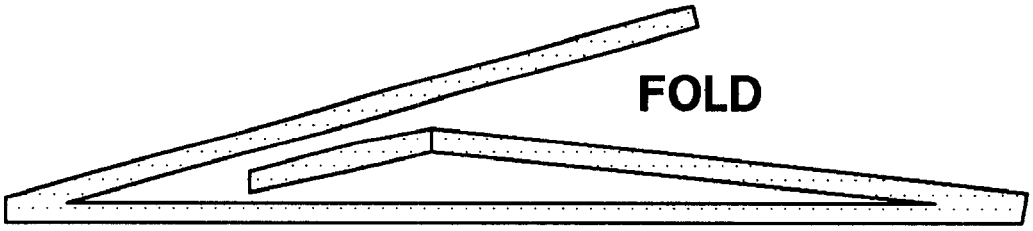
FIG. 5 shows the folding method used to construct the tulle pocket.
Figure 6:
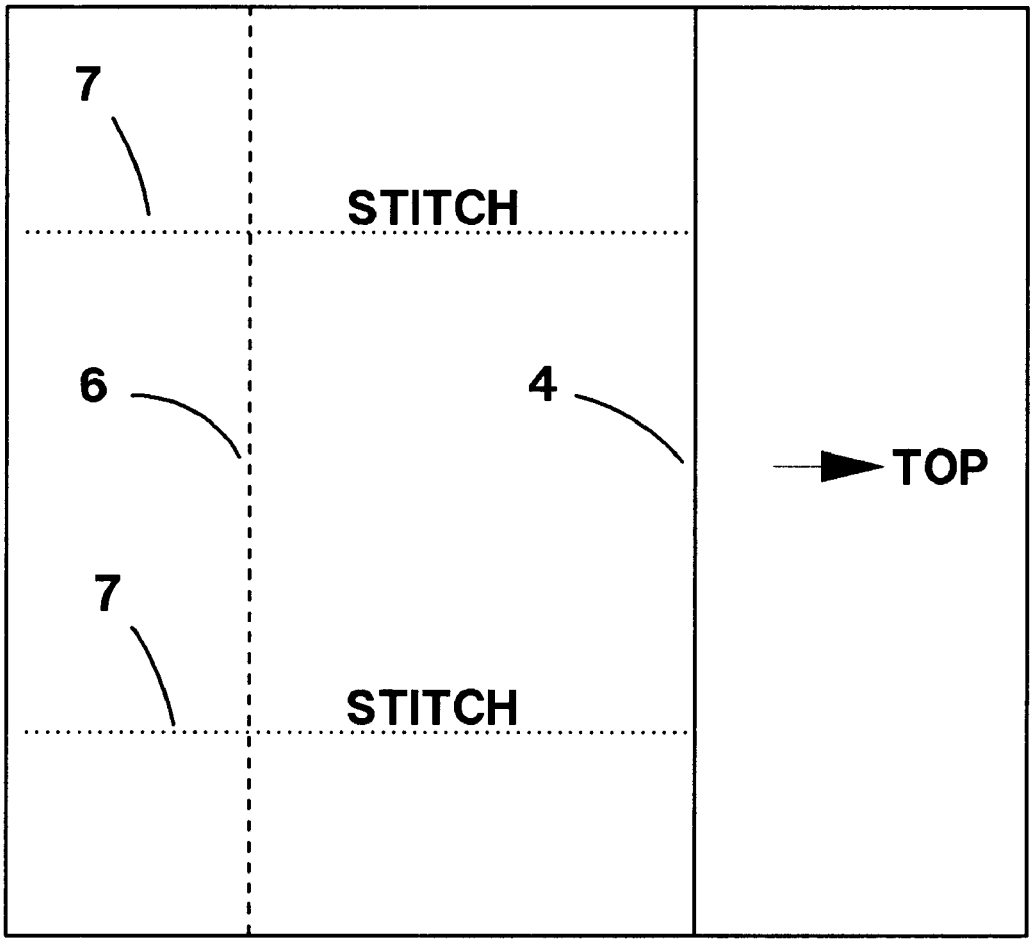
FIG. 6 is a front view of FIG. 5

FIG. 5 and FIG. 6 show the method of constructing the pocket and hence the soap dispensing system. A rectangular piece of elastic tulle of around 10 inches long and 5 inches wide is folded twice. A first fold 6 is made about 3 inches down on the 10 inch length. This forms a first flap. A second fold is then made about 3 inches from the opposite end. The second fold leaves a long slit 4. The two folds are parallel as shown in FIG. 5 with the outer flap overlapping the under flap. Stitches 7 are then made in the pocket only (there is no washcloth present at this point in the construction). These stitches are optimally placed around ¾ inch from the left and right sides. The piece can optionally be tacked down after folding to facilitate stitching. Finally, the piece is sewed onto the washcloth by stitching all around the outside as shown in FIG. 1.

The present invention is a system and method of dispensing soap from a washcloth. It can be used with a shower or bath. Solid soap in any form can be placed in a specially constructed elastic tulle pocket for tight retention during washing. Bar soap can easily be removed at any time if it is also desired to use the cloth during rinsing. The present invention stimulates blood circulation without harshness to the face or body. It can supply a continuous soap lather while bathing, and it can be used with individual soap preferences. There is no hair snag or other obstruction because the tulle pocket blends into the cloth. The wash cloth can be hand cleaned after each use by removing the soap and then rubbing the cloth together. The cloth can be machine washed at any time without damage to the tulle pocket.

It should be noted that the embodiments and drawings herein described are for purposes of illustration only. The present invention is not limited to these particular embodiments. Numerous modifications and changes are within the scope of the present invention. The present invention is limited in scope only by the claims.

I claim:

1. A soap dispensing washcloth system comprising:

a washcloth;

an elastic tulle pocket attached to said washcloth, said pocket containing:

an inner flap created by folding a piece of tulle on a first fold line;

an outer flap created by further folding said piece of tulle on a second fold line, said outer flap overlaying said inner flap;

at least two lines of stitches perpendicular to said fold lines, said stitches and said folding creating a pocket for retaining soap, wherein said lines of stitches created the pocket penetrate only elastic tulle.

2. The soap dispensing washcloth system of claim 1 wherein said tulle pocket provides support for soap in four directions.

3. The soap dispensing washcloth system of claim 1 wherein said tulle pocket is attached to one quadrant of said washcloth.

4. The soap dispensing washcloth system of claim 1 wherein said elastic tulle has cells around 1 mm.

5. The soap dispensing washcloth system of claim 1 further comprising a plurality of elastic tulle pockets attached to said washcloth.

6. The soap dispensing washcloth system of claim 5 wherein different of said plurality of pockets are made from elastic tulle of different cell sizes.

7. The soap dispensing washcloth system of claim 1 wherein said pocket is rectangular around 4 by 5 inches.

8. The soap dispensing washcloth system of claim 1 wherein said pocket is sewed around 1 inch from edges of said washcloth.

9. A washcloth for personal hygiene of the type that dispenses soap, the washcloth comprising a flat cloth background member of washcloth material with two faces with a pocket sewed onto one of the faces, the pocket being made by folding a piece of elastic tulle material into two overlapping parallel flaps, the flaps being stitched perpendicularly to the folding in two places, the flaps and the stitches forming a pocket for holding soap, this pocket then being sewed onto the cloth background member, the stitches forming the pocket not penetrating the background member.

10. The washcloth of claim 9 wherein the elastic tulle material has cells around 1 mm.

11. The washcloth of claim 9 wherein the pocket is in one quadrant of the background member.

12. The washcloth of claim 9 further comprising a plurality of pockets sewed onto said background member.

13. The washcloth of claim 12 wherein different of said pockets contain elastic tulle of different cell sizes.

14. A method for making a soap dispensing washcloth comprising the steps of:

cutting a piece of elastic tulle to size, said piece having a first and second dimension;

laying said piece of tulle flat and making a first fold at approximately ¼ to ⅓ along said first dimension, said first fold forming an inner flap;

making a second fold parallel to said first fold at an opposite approximately symmetrical position, again ¼ to ⅓ along said first dimension, said second fold overlapping said first fold;

stitching perpendicular to said folds in two rows, said stitched rows at positions approximately ⅕ along said said second dimension, said stitched rows and said folds forming a pocket having a perimeter, said pocket to hold soap;

sewing said pocket onto a washcloth by stitching along said perimeter, wherein the stitches forming the pocket not penetrating the washcloth.

15. The method of claim 14 wherein said elastic tulle has cells of around 1 mm.

16. The method of claim 14 wherein said pocket is sewed onto one quadrant of said washcloth.

17. The method of claim 16 wherein said pocket is sewed approximately one inch from edges of said washcloth.

18. The method of claim 14 wherein said piece of elastic tulle is rectangular.

* * * * *